United States Patent [19]

Sheldon et al.

[11] 3,985,465

[45] Oct. 12, 1976

[54] TURBOMACHINE WITH REMOVABLE STATOR VANE

[75] Inventors: Donald E. Sheldon, East Hartford; Richmond G. Shuttleworth, Vernon, both of Conn.

[73] Assignee: United Technologies Corporation, Hartford, Conn.

[22] Filed: June 25, 1975

[21] Appl. No.: 590,207

[52] U.S. Cl. ..... 415/189; 415/201; 415/217; 416/500

[51] Int. Cl.[2] ..... F01D 5/26; F01D 9/00

[58] Field of Search ..... 415/189, 190, 201, 216, 415/217, 218, 219; 416/215, 216

[56] References Cited

UNITED STATES PATENTS

| | | | |
|---|---|---|---|
| 920,438 | 5/1909 | Curtis | 415/189 |
| 1,366,592 | 1/1921 | Pentheny et al. | 416/216 |
| 2,661,147 | 12/1953 | Anderson | 415/218 |
| 2,945,290 | 7/1960 | Walsh | 415/218 |
| 2,995,294 | 8/1961 | Warnken | 415/190 |
| 3,326,523 | 6/1967 | Bobo | 415/218 |
| 3,501,247 | 3/1970 | Tournere | 415/189 |
| 3,807,895 | 4/1974 | McMurtry | 416/215 |
| 3,945,760 | 3/1976 | Miller | 415/201 |

FOREIGN PATENTS OR APPLICATIONS

| | | | |
|---|---|---|---|
| 690,153 | 6/1930 | France | 416/216 |
| 891,422 | 12/1943 | France | 415/217 |
| 54,970 | 6/1920 | Sweden | 416/216 |
| 572,859 | 10/1945 | United Kingdom | 415/189 |
| 599,391 | 3/1948 | United Kingdom | 416/216 |
| 815,032 | 6/1959 | United Kingdom | 415/217 |
| 779,060 | 7/1957 | United Kingdom | 415/189 |

*Primary Examiner*—Henry F. Raduazo
*Attorney, Agent, or Firm*—Vernon F. Hauschild

[57] ABSTRACT

An axial flow compressor or turbine includes a stator case with a plug which is removable from outside the case, together with one or more stator vanes attached to the plug, to provide access to an adjacent part of the rotor. Such access may be used to add balance weights to the rotor as part of a rotor balancing procedure, or for inspection of rotor blades.

4 Claims, 9 Drawing Figures

FIG. 1
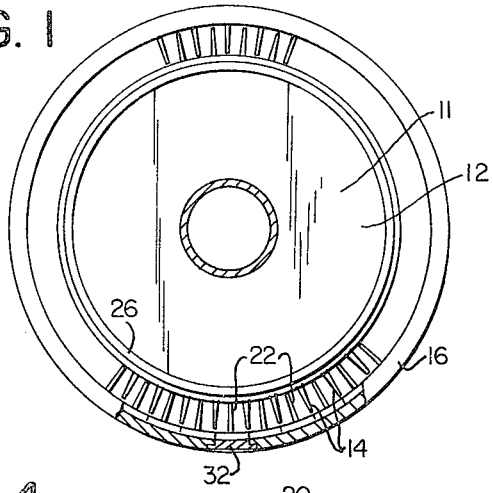
FIG. 2
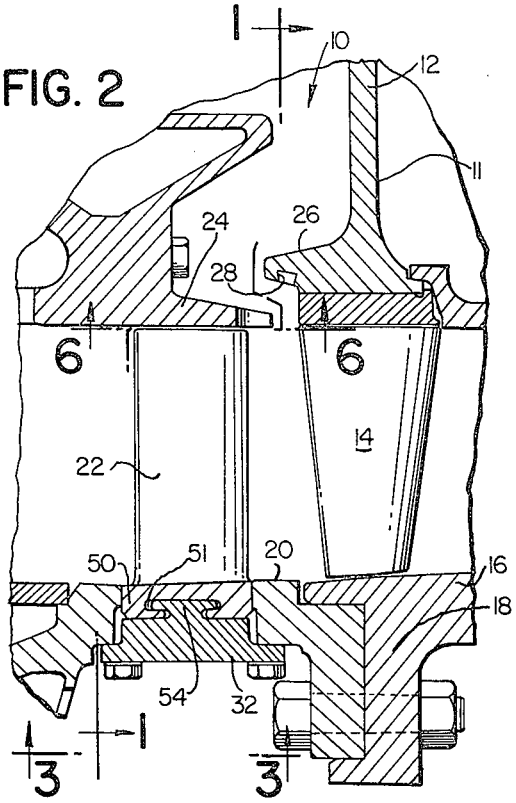
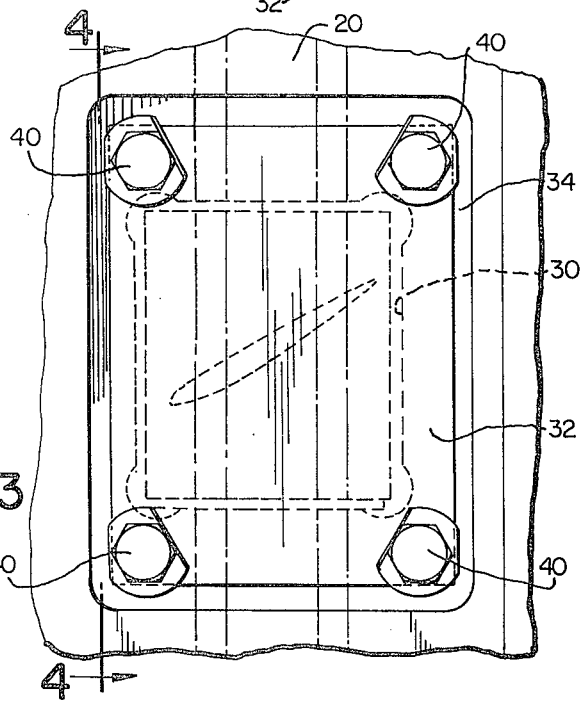
FIG. 3
FIG. 4
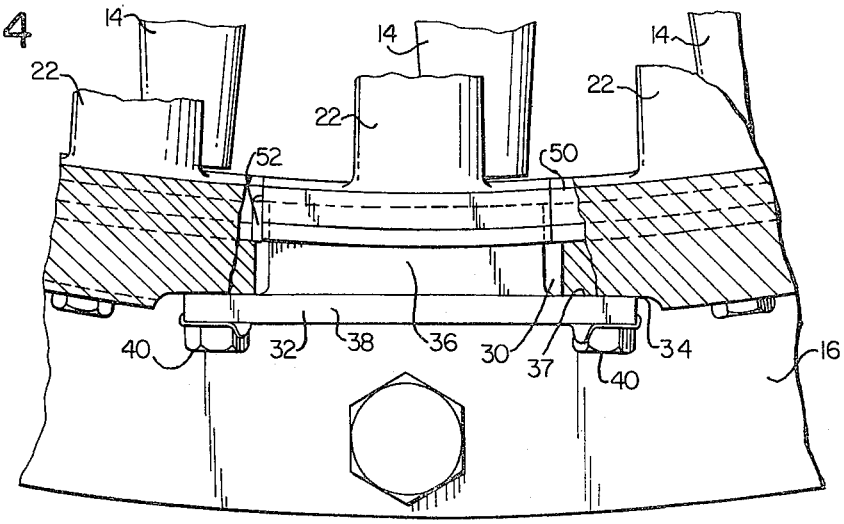

TURBOMACHINE WITH REMOVABLE STATOR VANE

BACKGROUND OF THE INVENTION

This invention relates to axial flow compressors or turbines, such as those forming a part of a turbojet engine, and deals more particularly with a compressor or turbine construction having a removable stator vane providing easy access to a portion of the rotor for rotor balancing, inspection, repair or other purposes.

In the manufacture and use of turbojet engines and other turbomachines it is often necessary to gain access to a rotor for various different purposes, and generally there are usually only one or a very few critical portions of the rotor to which access is needed on a relatively frequent basis. The purpose of this invention is to provide a means permitting access to such a critical rotor portion without requiring any major disassembly of the machine.

For example, the turbine and compressor rotors of turbojet engines normally rotate at high rotational speeds so that very small changes in their mass distribution have significant effects on their dynamic balance. Such changes in mass distribution occur from a number of factors, such as erosion, accumulation of dirt, distortion of parts and engine washing and is essentially unavoidable, so that is becomes necessary to trim balance the rotors at relatively frequent intervals. In performing such trim balancing, the degree and angle of the unbalance is determined while the rotor in question is driven at design speed in the actual engine installation, and then balance weights are attached to the rotor in its balance plane to compensate for the measured unbalance. In the past, this attachment of balance weights has many times required a difficult and lengthy disassembly of the engine to gain access to the rotor balance plane. The removable stator vane of this invention is, therefore, particularly useful for providing the access needed to add trim balance weights to a rotor.

Also, the removable stator vane feature of this invention may be used to provide a port allowing inspection and/or repair of an adjacent array of rotor blades. For example, rotor blades may occasionally become damaged by foreign objects passing through the flow path and the port provided by the removable vane allows one set of rotor blades to be inspected for such damage and further allows the damaged blades to be blended in place by blending tools, such as files, abrasive wheels, small milling cutters and the like, passed through the access port.

Other objects and advantages of the invention will be apparent from the following detailed description of the preferred embodiment thereof.

SUMMARY OF THE INVENTION

This invention resides in an axial flow turbomachine the stator of which is constructed to provide a stator vane, or a small group of adjacent stator vanes, which is removable from outside the machine, to provide access to the associated rotor, without major disassembly of other parts being required. In the construction of the invention, the stator has an annular case with an axial portion surrounding an annular array of stator vanes. At one location along its circumference this axial case portion has an access hole which passes radially therethrough. The hole is normally closed by a plug which is removably fixed to the case and which, when unfixed, is movable radially into and out of the hole. The majority of the stator vanes are attached directly to the surrounding axial case portion. The remainder of the vanes are attached to the plug so that when the plug is removed from the case, they are removed with it. Often it is sufficient for only one vane to be attached to and removable with the plug, but the invention contemplates that additional vanes may be attached to the plug if desired.

The invention also resides in the access hole being generally axially aligned with the balance plane of the associated rotor and with the rotor including a rotor disc or other hub member with a balance weight groove so arranged as to be accessible through the aforesaid hole to permit trim balance weights to be placed into said groove and attached to said rotor disc or other hub member by a suitable tool inserted through the access hole.

BRIEF DESCRIPTION OF THE DRAWINGS

FIG. 1 is a transverse cross-sectional view taken through a turbojet engine embodying this invention, the view being taken generally on the line 1—1 of FIG. 2.

FIG. 2 is a fragmentary longitudinal sectional view taken on the line 2—2 of FIG. 1, and drawn on a scale enlarged from that of FIG. 1.

FIG. 3 is a view of still further enlarged scale taken generally on the line 3—3 of FIG. 2 and showing the outer face of the removable plug.

FIG. 4 is a fragmentary transverse sectional view taken on line 4—4 of FIG. 3 with part of the case being broken away to reveal various other features.

DETAILED DESCRIPTION OF THE PREFERRED EMBODIMENT

Figure 7:
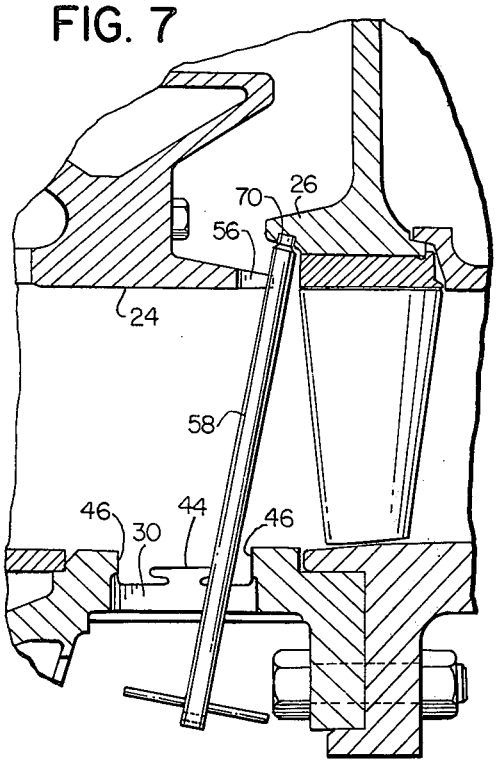
FIG. 7 is a view similar to FIG. 2 but with the removable vane and plug being shown removed from the case and with a balance weight attachment tool being shown inserted through the access hole to the balance weight groove of the rotor disc.

Turning first to FIGS. 1 and 2, these figures show a removable stator vane construction embodying this invention and incorporated, by way of example, in a turbojet engine indicated generally at 10. The particular portion of the engine 10 shown is the first or inlet stage of the high pressure compressor section, a low pressure compressor section being located in advance of, or to the left of, the structure shown in FIG. 2. The illustrated compressor section includes a rotor 11 having a disc 12 carrying an annular array of rotor blades 14, 14. An annular stator case 16 inclues one axial portion which surrounds the annular array of rotor blades 14 and immediately forward of the axial portion 18 it includes another axial portion 20 surrounding an annular array of stator blades 22, 22. The stator also includes an annular shroud 24 surrounded by the radially inner ends of the vanes 22, 22 and defining in part the flow path inlet to the rotor 11.

The rotor disc 12 and its blades 14, 14, as mentioned, are at the inlet end of the rotor 11, and radially inwardly of the blades the disc has an axially forwardly projecting lip 26 extending along its full circumference. The lip 26 has a circumferentially continuous, and radially outwardly opening, groove 28 formed therein which serves to receive balance weights for trim balancing the rotor, the groove 28 therefore establishing a balance plane for the rotor.

The rotor 11 is located a substantial distance from either end of the engine 10 so that access to the balance weight groove 28, or to any other part of the rotor 11, in previous engine constructions would usually be difficult to obtain and require considerable disassembly of the engine. In accordance with the present invention, however, access to the balance weight groove 28 is provided by an access hole 30 passing through the casing 16 and located at one location along the circumference of the axial case portion 20 which surrounds the vanes 22, 22. As shown best in FIGS. 3, 4 and 5, the access opening 30 is generally square in shape and is normally closed by a plug 32. The outside of the case 16 in the area surrounding the hole 30 is provided with a flat seat 34. The plug 32 includes a body 36 which fits into the hole 30 and a head 38 which extends laterally outwardly in all directions from the body 36 so as to form a flange having a flat seat 37 which normally flatly engages the seat 34 of the case as shown in FIG. 4. The plug is removably fixed to the case 16 by four bolts 40, 40 which pass loosely through the head 38 and which threadably engage the case 16. The bolts may be removed by unthreading them from the case 16, and when so removed the plug 36 is movable radially into and out of the access hole 30 from outside of the case. FIG. 2, for example, shows the plug in place in the access hole and FIG. 7 shows it removed from the hole.

The plug 36 has a circumferential length equivalent to one full stator vane pitch and one stator vane 22 is attached to it so that when the plug 36 is removed from the case 16, the attached vane is removed with it. The remainder of the vanes 22, 22 are attached to the annular case portion 20 in a conventional manner.

Figure 5:
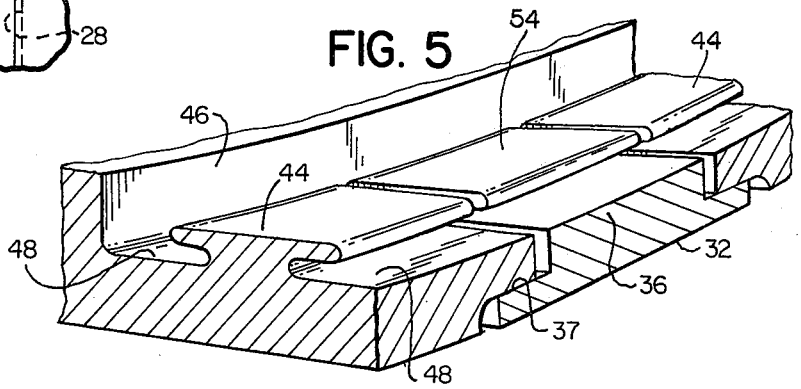
FIG. 5 is a fragmentary perspective view showing a portion of the stator case in the vicinity of the removable plug with the stator vanes being omitted.

In the illustrated construction, the means for attaching the vanes to the case 16, as shown best in FIGS. 4 and 5, consists of an annular rail 44 attached to the inside surface of the case within a circumferentially extending case groove defining axially spaced side bearing surfaces 46, 46 and bottom wall surfaces 48, 48. As shown in FIGS. 2 and 4, each vane 22 includes a radially outer and circumferentially extending root or platform 50 having a circumferentially extending groove 51 therein which has a shape generally complementary to that of the rail 44 and which receives the rail. The root groove 51 and rail 44 are of such cross-sectional shape that coengagement between the root groove and rail surfaces restrains each vane against movement relative to the case except for circumferential sliding movement along the length of the rail. The vanes 22, 22 are further cantilevered from the case 16 so that their radially inner ends are free and unattached to the shroud 24. Therefore, in the process of attaching the vanes to the case 16, they may be moved onto the rail 44 at a suitable loading station and then circumferentially slid along the rail to their final position. They are subsequently restrained against such circumferential sliding movement by one or more torque stops inserted in slots extending transversely of the rail 44 and located between adjacent ends of two abutting vane roots, one such torque stop being shown at 52 in FIG. 4.

The one removable vane attached to the plug 32 could be a part formed integral with the plug or a vane of some special design. Preferably, however, and as shown in the illustrated case, this vane is similar to all of the other vanes of its annular array, and for the purpose of attaching it to the plug 32, the radially inner end of the plug includes a circumferentially extending rail portion 54 having a cross section similar to that of the casing rail 44 and which, when the plug 32 is in place forms a continuation of the casing rail. The removable vane 22, therefore, as shown in FIG. 2, is attached to the plug 32 by having its root portion received on the rail portion 54 of the plug. Among other things, this allows the removable vane 22, if damaged, to be removed from the plug and replaced by a new similar vane.

Figure 6:
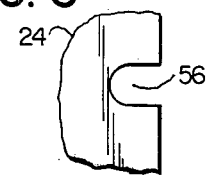
FIG. 6 is a view taken on the line 6—6 of FIG. 2.

When the plug 32 and associated removable vane 22 are removed from the casing, as shown in FIG. 7, access may be had to the balance weight groove 28 of the rotor disc 12, and such access is further enabled by a recess 56 cut into the inner shroud 24 in alignment with the access opening 40, as shown in FIGS. 2, 6 and 7.

Figure 8:
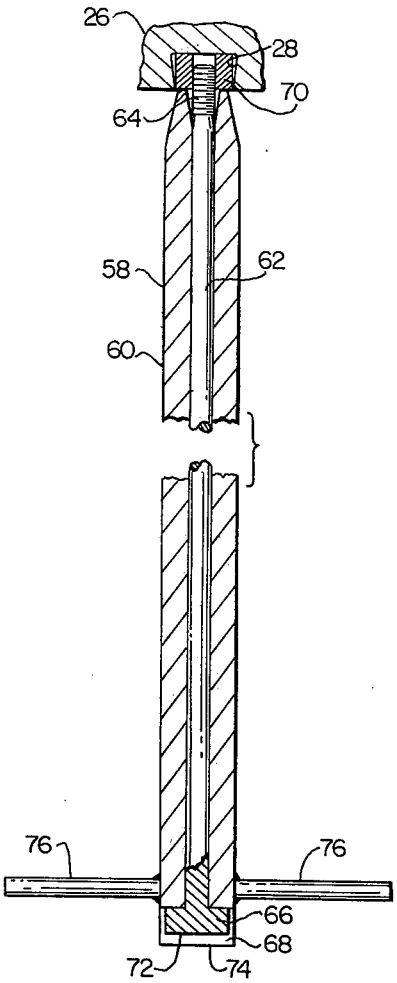
FIG. 8 is a longitudinal sectional view taken through the balance weight attachment tool, the tool being shown in the process of attaching a weight to the rotor disc.
Figure 9:
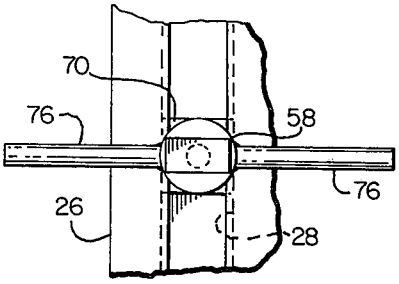
FIG. 9 is an end view of the tool of FIG. 8.

Balance weights may be added to the balance weight groove in various different ways, and FIGS. 7, 8 and 9 show one tool 58 which may be used for this purpose. Referring to these figures, the illustrated tool 58 includes a tubular stem 60 slidably receiving a central rod 62 having a threaded forward end portion 64. At its rear end the rod 62 has a rectangular head 66 received in a conforming notch 68 in the end of the stem. A balance weight is shown at 70 and consists of an annular member of relatively soft metal, such as soft brass or bronze, which may be threaded onto the threaded rod portion 64. The relative axial depths of the head 66 and notch 68 are such that when the weight 70 is threaded onto the threaded portion 64 to the point that the head 66 is drawn into engagement with the bottom of the notch 68, as shown in FIG. 8, the rear end surface 72 of the head is located inwardly of the rear end surface 74 of the stem.

The balance weight groove has a dove-tail cross section, as evident from FIG. 8. After a weight 70 is attached to the tool 58, as shown in FIG. 8, the weight is inserted into the balancing weight groove by inserting the tool through the access opening 30 and through the shroud notch 56, as shown in FIG. 7. Then the rear end of the tool is struck by a hammer until the stem end face 74 moves to alignment with the rod end face 72. This movement of the stem relative to the rod causes the stem to deform the weight 70 to the cross-sectional shape of the groove and to thereby fix it to the groove, the spacing between the end faces 72 and 74 when the parts are in the FIG. 8 position being such as to provide exactly the amount of balance weight deformation desired. After the balance weight is deformed into place in the groove, the rod 64 is unthreaded therefrom by rotating the stem. Handles 76, 76 are preferably fixed to the outer end of the stem for this purpose as well as to avoid the possibility of the tool 58 falling through the opening 30 and into the engine.

In addition to providing access to the balance weight groove 28, the removable vane and plug construction as above described could be used to provide access to the rotor 11 for other purposes. For example, in the same construction as illustrated, when the vane and plug are removed, as shown in FIG. 7, the hole 30 provides access to all of the blades 14, 14 attached to the rotor disc 12 since the rotor may be turned to move the blades past the access opening 30 and bring any desired blade into angular alignment with the opening. Accordingly, by looking through the opening 30, the blades 14, 14 may be inspected for damage, warpage, dirt accumulation and the like. Also, if any blade is found to be damaged, and if the damage is of a proper nature, it may be repaired in place as by blending with tools inserted through the opening 30.

Also, in the construction shown, each stator vane 22 is of such size that removal of one vane provides sufficient access to the rotor 11. It will be appreciated, however, that in cases where the blades are smaller the access opening, if desired, may be made of a circumferential length equivalent to two, three or perhaps more full vane pitches with an equivalent number of vanes being attached to the plug for removal therewith.

What is claimed is:

1. In an axial flow turbomachine, the combination comprising:

a rotor including at least one annular array of rotor blades, and a stator, said stator including an annular case having a first axial portion surrounding said array of rotor blades and a second axial portion immediately adjacent said first axial portion, an annular array of stator vanes surrounded by said second axial portion of said casing, said second axial case portion having an access hole passing radially therethrough at one location along its circumference, a plug movable radially into and out of said hole from the outside of said case, means removably fixing said plug to said case with said plug positioned in said hole, means attaching a majority of said stator vanes directly to said second axial case portion, means attaching the remainder of said vanes to said plug so that when said plug is removed from said case said remainder of said vanes are removed with it to permit access to said rotor, said rotor including a disc to which said annular array of rotor blades is attached, said disc having an annular portion extending axially toward said annular array of stator vanes and having a radially outwardly opening groove formed therein for receiving balance weights, said stator including an inner annular shroud surrounded by the radially inner ends of said annular array of stator vanes, said balance weight groove of said disc being located generally radially inwardly of said shroud, and said shroud having a recess therein generally aligned with said access hole to permit a tool to be inserted into said hole and through said shroud recess to said balance weight groove.

2. In an axial flow turbomachine, the combination comprising:

a rotor including at least one annular array of rotor blades, a stator having an annular array of stator vanes in axial alignment with said blades, surrounding said array of rotor blades and vanes and having an access hole passing radially therethrough at one location along its circumference and in axial alignment with said vanes, a plug movable radially into and out of said hole from the outside of said case, means removably fixing said plug to said case with said plug positioned in said hole, means attaching at least one of said vanes to said plug so that when said plug is removed from said case said vane is removed with it to permit access to said rotor, means attaching the remainder said stator vanes directly to said case, said rotor including a disc to which said annular array of rotor blades is attached, said disc having annular portion extending axially toward said annular array of stator vanes and having a radially outwardly opening circumferential groove formed therein and lying in the rotor balance plane for receiving balance weights, said stator including an inner annular shroud surrounded by the radially inner ends of said annular array of stator vanes, and said balance weight groove of said disc and said inner annular shroud of said stator being located and shaped so as to provide access to said balance weight groove through said hole when said plug and attached vane are removed.

3. A turbomachine according to claim 2 wherein said balance weight groove is shaped dove-tailed in cross section.

4. In an axial flow turbomachine, the combination comprising:

an annular stator case, an annular array of stator vanes surrounded by said case, said case having access hole passing radially therethrough at one location along its circumference and aligned axially of said case with said array of stator vanes, a plug movable radially into and out of said hole from the outside of said case, means removably fixing said plug to said case with said plug positioned in said hole, means attaching the remainder of said stator vanes directly to said case, and means attaching at least one of said vanes to said plug so that when said plug is removed from said case said vane is removed with it to provide access to an interior portion of said turbomachine, a bladed rotor enveloped within said case with its blades in axial alignment with said vanes and having a radially outwardly opening balance weight groove extending circumferentially therearound and located to present access thereto through said hole when said plug and attached vane are removed.

* * * * *